United States Patent [19]

Kwok et al.

[11] 4,074,727

[45] Feb. 21, 1978

[54] LIQUID SUPPLY SYSTEM AND NOZZLE FOR JET WEAVING LOOMS

[75] Inventors: Clyde Chi Kai Kwok, Montreal; Joseph Rene Cornellier, Knowlton, both of Canada

[73] Assignee: Joseph Rene Cornellier, Knowlton, Canada

[21] Appl. No.: 690,660

[22] Filed: May 27, 1976

[51] Int. Cl.[2] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 3,576,284 | 4/1971 | Fellows et al. | 226/97 |
| 3,655,862 | 4/1972 | Dorschner et al. | 226/97 |
| 3,782,422 | 1/1974 | Vermewler | 139/435 |
| 3,863,822 | 2/1975 | Keldany | 139/435 |
| 3,977,442 | 8/1976 | Shibata et al. | 139/435 |

FOREIGN PATENT DOCUMENTS

| | | | |
|---|---|---|---|
| 1,279,567 | 10/1968 | Germany | 139/435 |

*Primary Examiner*—Henry S. Jaudon
*Attorney, Agent, or Firm*—McFadden, Fincham & Co.

[57] ABSTRACT

A liquid supply system and a nozzle construction for a jet weaving loom. The nozzle is supplied directly from a public water works at the normal pressure of said water works. The exact amount of water required to propel the weft yarn across the open harness shed of the loom is obtained by a solenoid valve series-connected to the water supply adjacent the nozzle and controlled by an electric pulsator which is adjustable to open the valve for the required time in accordance with the width of the weaving and the type of weft yarn. Synchronization of the operation of the nozzle with the harness motion is obtained by a switch controlling the pulsator and directly operated by a cam connected to a shaft of the main movement of the weaving loom. The nozzle structure comprises only two parts: namely, a bored body having a main cylindrical bore portion followed by a tapered frusto-conical bore portion, in turn followed by a cylindrical terminal outlet bore portion and a needle axially adjustable within the body bore, defining an annular space with the latter and having a slightly tapered terminal end fitted within the outlet bore portion of the body. The needle has an axial passage for the yarn. The water is admitted laterally within the body directly into the annular space. The nozzle is able to propel the yarn at a considerable distance with a minimum quantity of liquid and at a low liquid pressure. There is minimum deviation and dispersion of the liquid jet across the harness shed.

17 Claims, 6 Drawing Figures

LIQUID SUPPLY SYSTEM AND NOZZLE FOR JET WEAVING LOOMS

The present invention relates to jet looms, and more particularly, to the liquid supply system and to the nozzle structure of such a jet loom.

In known liquid jet loom constructions, the nozzle for launching the thread is supplied with liquid at relatively high pressure, for instance at approximately 125 pounds per square inch and, therefore, cannot use the public works water supply, which is normally at a much lower pressure, for instance in the range of 40 to 60 pounds per square inch. Therefore, these conventional jet weaving looms require a complicated and highly precise liquid supply pump which not only must supply the liquid at the required pressure, but also in a highly precise amount and in exact synchronism with the mechanical movement of the loom. Normally, this pump is associated with a water reservoir and a float to maintain the liquid level constant at the intake of the pump. This pumping system requires constant maintenance and is subject to frequent breakdown, resulting in lost loom productivity.

It is also known in the prior art to provide a loom construction with fluid supplying means by supplying a fluid to a pump which is driven from the drive means of the loom through engagement of a cam and cam follower. The problem with such an arrangement is the adjustment of the angular position of the cam relative to the cam follower and amount of preload required, etc. To overcome this, the prior art also proposes that such an apparatus be modified by providing means for generating an electric signal which is synchronized with the operation of the loom, modifying the signal to produce pulses which are also synchronized with the loom but are variable with respect to pulse width, and incorporating a valve between the nozzle and pump, the valve having a solenoid which is connected to the pulse modifier to open and close the valve in a synchronized manner with respect to the pulses. In the prior art, there is also taught a pressurized accumulator located generally upstream of the valve means, which can be considered to be analogous to, for example, a pressurized water tank employed in a well system. The accumulator stores the water under pressure and "evens out" the pressure drop during the duration of its operation; the pressure is quite high for the initial period of time and then declines to a lower value during the terminal portion of the delivery of the water.

In accordance with this invention, there is provided, in one aspect, and in such a system, an improvement to such a system which in brief summary may be described as a device having a liquid supply system and a nozzle for propelling a weft yarn across the open shed of warp yarn, said nozzle having a weft yarn passage and an annular liquid passage and a front outlet surrounding the weft yarn passage, said liquid passage having an inlet and including a back chamber feeding into a forwardly tapering passage portion in turn feeding into a substantially cylindrical passage portion, a remote-controlled valve having a liquid outlet connected to the liquid passage inlet of the nozzle, said valve having a liquid inlet, means to supply liquid at substantially constant pressure to said liquid inlet of said valve, pulse generating means connected to said valve to supply a pulse to the latter of predetermined duration and open said valve only during the time of said pulse, and signalling means to cause operation of said pulse generating means, actuated by the beating or harness motion of said loom, whereby said valve operates in synchronism with said motion.

In addition, in accordance with a further aspect of this invention, there is provided an improvement in a nozzle construction for use in such a system, the nozzle comprising a nozzle for propelling a weft yarn across the open shed of warp yarns, said nozzle comprising a body having a through bore, a needle inserted in said through bore and having an axial yarn passage, said body through bore defining a main cylindrical portion preceded by a forwardly tapering frusto-conical portion, in turn preceded by an outlet cylindrical portion of restricted diameter, all said three portions merging with one another, said needle defining a main cylindrical portion preceded by a forwardly tapering frusto-conical portion, in turn preceded by a slightly forwardly tapered terminal portion, the needle being coaxial with the body through bore and defining an annular liquid passage therewith, means to adjustably position said needle axially of said through bore, said body having a liquid inlet in communication with said liquid passage at said main cylindrical portion of said through bore.

The improvements of the present invention provide liquid jet looms which are more efficient and less complicated than the prior art; also, systems of the present invention permit the jet weaving looms to operate at relatively low pressure and at the same time, require a minimum quantity of liquid to propel the filling across the harness shed and furthermore, the nozzle permits the propelling of the filling at a great distance whereby it is suitable for use with looms of at least 6 feet in width. In addition, the liquid jet of the present invention permits minimum deviation and dispersion compared to prior art forms, during its travel across the loom.

Still further, with the present invention, there is provided a system which is capable of operating on a low pressure liquid supply — e.g., at the normal pressure of public water supply systems, and the system of the present invention includes a remote control valve operated by a pulse of adjustable and precise duration whereby conventional pumps and associated liquid supply systems are eliminated.

Having thus generally described the invention, references will now be made to the accompanying drawings, illustrating preferred embodiments and in which.

In the drawings, like reference characters indicate like elements throughout.

Figure 1:
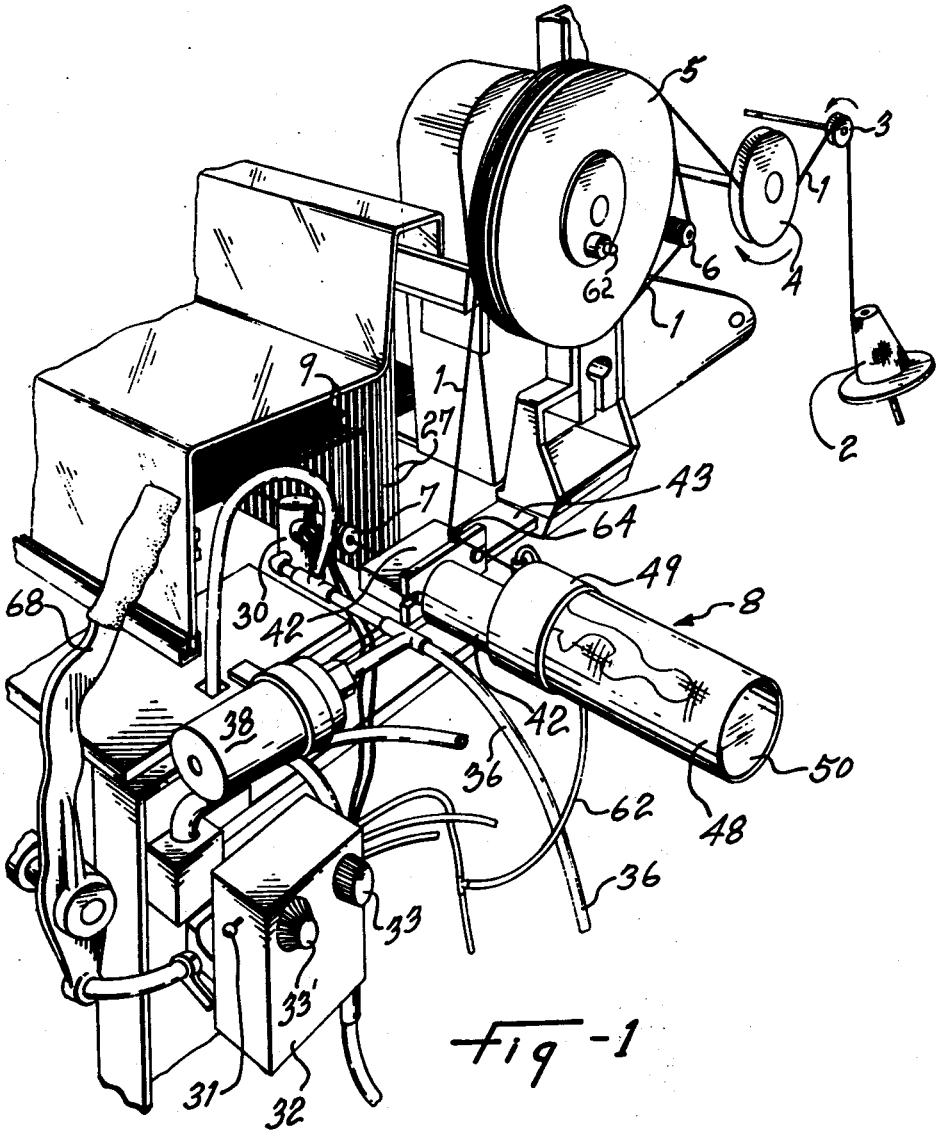
FIG. 1 is a general perspective view showing part of a jet weaving loom fitted with the nozzle and associated liquid supply of the invention and showing also the weft yarn measuring system and the yarn storage system.

The weft yarn 1 from a supply package 2 is trained on guide pulleys 3, 4 and then into a measuring drum 5 and pulley 6, the drum 5 being operated by the loom drive at a speed adjusted to supply yarn 1 in a continuous manner at the rate required for the pick motion. The yarn 1 is then temporarily detained in a storage device 8 between each operation of a weft yarn propelling nozzle 7. Nozzle 7 throws a filling between the warp yarns 9 operated by the conventional harnesses 27.

Figure 3:
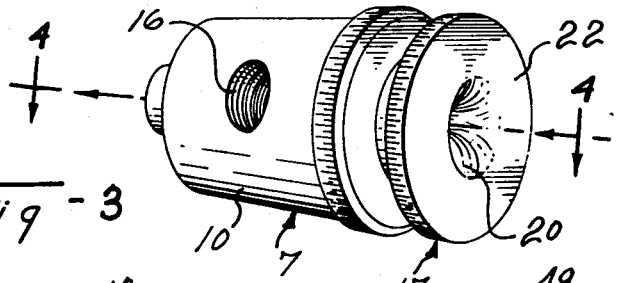
FIG. 3 is a perspective view of the nozzle per se.
Figure 4:
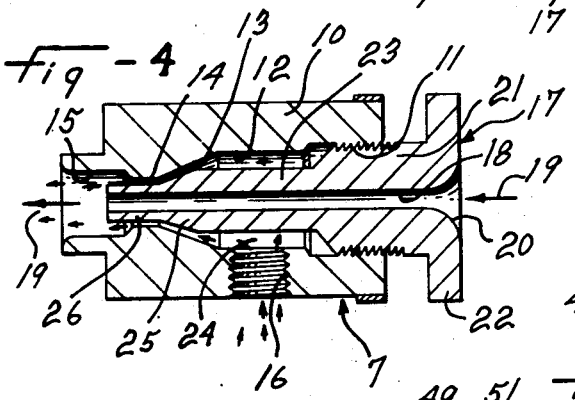
FIG. 4 is a longitudinal section of the nozzle taken along line 4—4 of FIG. 3.

Nozzle 7 is illustrated in FIGS. 3 and 4. It includes a generally cylindrical body 10 having an axial bore defining from back to front a threaded portion 11, a main cylindrical bore portion 12, a frusto-conical portion 13 tapering from main cylindrical portion 12 and a terminal cylindrical bore portion 14, of reduced diameter, merging with the small base end of the frusto-conical bore portion 13. The terminal portion 14 opens within a cylindrical, enlarged mouth 15. As an example, frusto-conical portion 13 makes an angle of between 18° and 22° with the axis of the bore of the body, and preferably 20°.

In this example, the length of the terminal cylindrical bore portion 14 is a minimum of 1 inch and a maximum of ⅜ inch.

A threaded liquid inlet 16 opens laterally within main cylindrical portion 12.

The nozzle further includes a needle 17 adjustably screwed within the bore body 10. Needle 17 has an axial through bore 18 for the passage of the weft yarn from back to front in accordance with arrows 19. The inlet end of the yarn passage 18 is flared, as shown at 20, to minimize friction on the yarn.

The needle includes a main body 21 having external threads for engaging with body threads 11. Said main portion has a rear flange 22 for manually adjusting the axial position of the needle 17 in body 10.

The main portion 21 is followed by a main cylindrical portion 23 opposite main bore portion 12 to define therewith an annular cylindrical space 24.

Needle cylindrical portion 23 extends forwardly opposite frusto-conical body portion 13 and merges with a needle frusto-conical portion 25 tapering forwardly to be preceded by a needle terminal 26, which extends opposite body bore portion 14 and protrudes within the mouth 15. Needle terminal portion 26 is slightly tapered forwardly, the taper being about 4°.

The annular space between needle portion 26 and body bore portion 14 is between 4 and 8 mils in width. The frusto-conical portion 25 of the needle tapers at a slightly smaller angle than the frusto-conical portion 13 of the body, so as to define an annular converging passage decreasing in width slightly in the forward direction.

It will be understood that by adjusting the axial position of the needle, the annular passage between frusto-conical portions 13 and 25 will decrease or increase in width accordingly, thus making an adjustment of the flow of fluid for a given fluid pressure.

It is noted that the nozzle defines at least a two-stage taper, namely needle surfaces 25 and 26 and cooperating body bore surfaces 13 and 14 for the formation of the liquid jet having maximum energy content for a given liquid supply pressure. Yet the nozzle is simple and inexpensive to manufacture.

Practical operation of this nozzle has shown that a weft thread can be effectively propelled a distance of up to 72 inches through the shed of arrayed warp yarn in a shuttleless loom with a liquid supply pressure of about 45 pounds and a quantity of water of less than 3 centimeter cube ejected up to a maximum of 50 milliseconds, the yarn used being a 150 denier acetate yarn. This compares with conventional jets in which a liquid pressure of 125 pounds per square inch is used and a minimum quantity of 4 to 6 centimeter cube of water is necessary to propel the yarn the above-noted distance.

Referring to FIG. 1, the inlet 16 of the nozzle 7 is directly connected to the outlet of an adjacent remote-controlled valve, for instance an electro-magnetic valve, indicated at 30, this valve being of conventional type and being electrically connected (see also FIG. 2) to the output of an electric pulsator 32 which is arranged to produce an electric pulse to operate electro valve 30 for an adjustable duration of, say, between 0 and 50 milliseconds, the duration being controlled by a knob 33.

The input of the pulsator 32 is controlled either by a manual button switch 31 or by a micro switch 33, the lever 34 of which rides on a cam 35 directly connected to a rotatable shaft 35′ of the loom, so that the switch 33 will open and close in synchronism with the beating or harness motion of the loom. Thus, each time the shed of the warp yarns is open, the electric circuit to the pulsator is closed and the latter opens the electro valve 30 for the adjusted number of milliseconds, so that the liquid jet will propel the yarn from the passage 18 of the needle 17.

The electric pulsator is preferably provided with a variable time delay circuit adjustable by a manual knob 33′. This delay system retards in an adjustable manner the time the electric pulse or signal is sent to electro-magnetic valve 30 from the time cam-operated switch 33 is closed. Thus, one can finely control the synchronization of the nozzle operation with the harness motion and the beating motion.

Instead of a cam-operated switch 33, one could use any other transducer such as a photocell responsive to a light beam reflected off a surface portion of the loom shaft 35′ or magnetic transducer responsive to the rotation of loom shaft 35′. Thus, wear of mechanical parts is eliminated.

The electro-magnetic valve 30 can be replaced by a pneumatic valve and the pulsator 32 replaced by a pulsator which is electrically operated to generate a signal in the form of a pulse of pressurized gas to actuate the pneumatic valve.

The liquid jet issuing from the nozzle is tubular in form and adheres to the weft yarn, to effectively propel the same.

Figure 2:
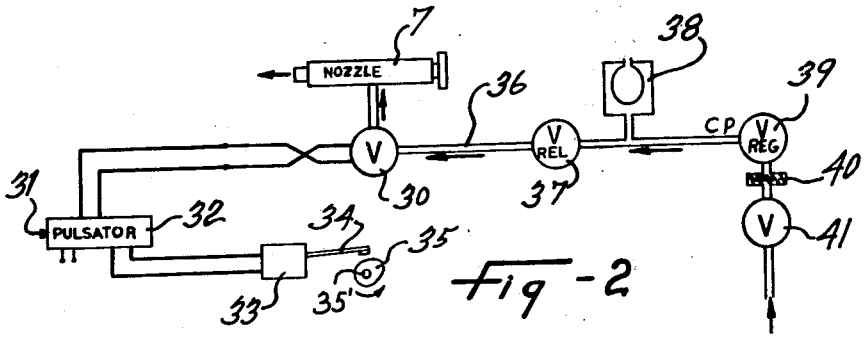
FIG. 2 is a diagram of the liquid supply system to the nozzle with the electrical controls therefor.

The water supply for the inlet of the valve 30 is indicated in FIG. 2 by a pipe 26, which is series-connected with a bleeding valve 37 to remove the air in the water, in turn preceded by an accumulator 38, of known type, to eliminate water hammer, in turn preceded by a liquid pressure regulating valve 39, in turn preceded by a liquid filter 40 and a shut-off valve 41, the inlet of which can be connected to the regular public works water supply. Obviously valve 30 can be connected to any other suitable low pressure liquid supply.

Figure 6:
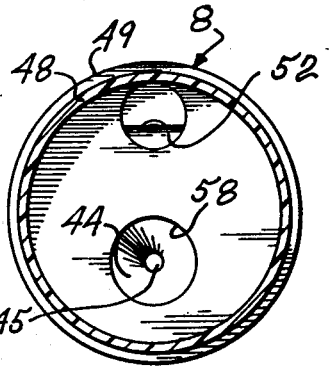
FIG. 6 is a cross-section along line 6—6 of FIG. 5.
Figure 5:
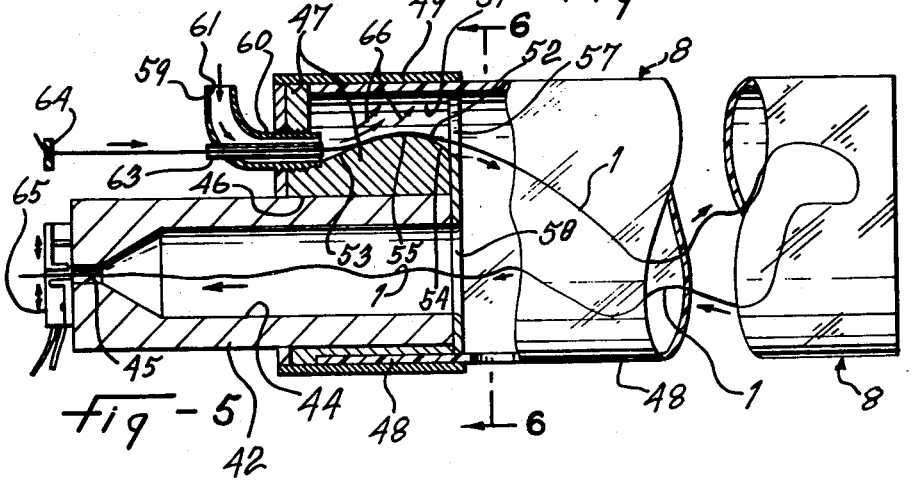
FIG. 5 is a partial longitudinal section of the filling storage device.

Before the weft yarn 1 enters the nozzle 7 and upon leaving the constant speed measuring drum 5, it is detained or stored in a storage tube 8. This storage tube is shown in FIGS. 1, 5 and 6. Each storage tube comprises a head member consisting of blocks 42 and 47. Block 42 is secured to the frame 43 of the machine. Block 42 has a yarn passage 44, shown in FIG. 5, with a restricted outlet opening 45 in substantial alignment with the yarn passage 18 of the nozzle 7, the latter being also mounted together with the solenoid valve 30 on the loom frame 43.

The rear end of block 42 is inserted within an eccentric bore 46 of cylindrical block member 47, which is thus supported by block 42 and in turn supports in cantilevered manner an elongated chamber or tube 48 telescopically fitted about block 47 and retained thereon by a collar 49.

Tube 48 is open at its outer end 50 and can be made of transparent plastic material to enable viewing of the weft yarn 1 therein.

Block 47 has an inlet passage 51 offset from bore 46 and generally parallel thereto, said passage being generally cylindrical, except for a transversely flat surface 52, which defines, longitudinally of the inlet passage, an upwardly inclined portion 53, followed by a downwardly inclined portion 54, the two portions merging in a smooth manner by means of an intermediate convex portion 55.

A disc 56 is inserted within tube 48 and applied against the inside face of block 47. This disc 56 has circular openings 57 and 58 in register with the inlet passage 51 and with the block passage 44, respectively.

An elbow nipple 59 is threaded within block 47 at the outer face thereof and its outlet passage 60 is parallel to block passage 40 and is directed against the upwardly inclined portion 53 and the convex portion 55 of the surface 52 of the inlet passage 51.

The inlet 61 of elbow 59 is connected to a supply of compressed air by tubing 62 (see FIG. 1). A small diameter tube 63 extends within the outlet passage 60 of elbow 59, being concentric therewith, said small tube extending through the wall of the elbow 59. Tube 48 has an air inlet opening 67 adjacent block 47.

Weft yarn 1 coming from the measuring drum 5 moves through a guiding eyelet 64 aligned with small tube 63 and then passes through said tube 63 into inlet passage 51, through disc opening 57 and then freely into the main tube 48. The yarn makes a floating loop in the tube 48 and returns through disc opening 58; block passage 44; restricted block outlet 45 to enter the nozzle 7. An electrically-operated gripper 65 is mounted at the outlet of block 42 in register with outlet 45 of said block.

Compressed air issuing as an annulus from elbow 60 surrounds yarn 1 and positively propels the latter into the inlet passage 51. The air immediately hits the upwardly inclined surface portion 53 and is thus immediately directed against the opposite surface of the inlet passage 51, as indicated by arrows 66. The air is thus diverted away from the yarn. The compressed air then enters the tube 48 and there is produced a slow moving air current in tube 48 directed towards the open end 50, where the air freely escapes. This air current sucks in fresh air through air opening 67. This slow-moving air current, together with supplemental air entering through opening 67, is sufficient to keep the thread 1 freely floating in the tube 48 without touching the wall of the latter. Air opening 67 also prevents the production of negative gas pressure at the entrance of block passage 44.

Because the high velocity pressurized air issuing from nipple 59 is immediately diverted upwardly by the upwardly inclined surface portion 53, this high velocity air is in contact with the yarn 1 over a very restricted length of the latter, whereby the air cannot in any way damage the yarn 1. Damage would result if the air under high velocity was allowed to be in contact with the yarn over a substantial length thereof.

The yarn within tube 48 has been found to float freely without yarn entanglement. The yarn is freely fed to the nozzle 7 upon operation of the same. Once the required length of a yarn has been propelled by the nozzle, the electrically operated gripper 64 operates to grip the yarn at the block outlet 45. The gripper releases the yarn after stopping of the nozzle operation.

Referring to FIG. 1, hand lever 68 is conventional and serves to start and stop the loom.

The nozzle system of the invention can be manually operated for testing the loom: a knob 69 on the measuring drum 5 is pulled to declutch the latter and the drum is manually rotated to the required length as seen in tube 48. Then pulsator 32 is manually actuated by pushbutton switch 31 to produce one pulse and effect one filling.

It is known that the yarns used in weaving are coated with chemicals and/or oily substances which cause a build-up on the inner surfaces of the storage tube if the yarn is allowed to touch the latter. This happens in conventional vacuum operated storage tubes, because of their small cross-sectional size necessitated by the use of vacuum. Thus, these vacuum tubes must be cleaned frequently. Also, it is less expensive to produce compressed gas than to use a vacuum pump.

Finally, the use of a gas jet nozzle, such as the nozzle constituted by elbow nipple 59, positively pulls the yarn 1 from the measuring drum 5 and therefore, maintains constant tension on the portion of the yarn preventing its slippage on the drum 5.

It will be understood that various modifications can be made to the above-described embodiments without departing from the spirit and scope of the invention.

We claim:

1. In a jet weaving loom, the improvement comprising a liquid supply system and a nozzle for propelling a weft yarn across the open shed of warp yarn, said nozzle comprising a weft yarn passage, an annular liquid passage, and a front outlet surrounding the weft yarn passage, said liquid passage having an inlet in communication with a back chamber, said back chamber feeding into and merging with a first conical forwardly tapering passage portion which in turn feeds into and merges with a forwardly tapering terminal portion, a remote-controlled valve having a liquid outlet connected to the liquid passage inlet of the nozzle, said valve having a liquid inlet, means to supply liquid at substantially constant low pressure to said liquid inlet of said valve, pulse generating means connected to said valve to supply a pulse to the latter of predetermined duration and open said valve only during the time of said pulse, and signalling means to cause operation of said pulse generating means, actuated by the beating or harness motion of said loom, whereby said valve operates in synchronism with said motion.

2. In a jet weaving loom, the improvement comprising a liquid supply system and nozzle said nozzle comprising a body having a through bore, a needle inserted in said through bore and having a weft yarn passage which extends axially of said needle, said body through bore defining a main cylindrical portion preceded by a forwardly tapering frusto-conical portion, in turn preceded by an outlet cylindrical portion of restricted diameter, all said three portions merging with one another, said needle defining a main cylindrical portion preceded by a forwardly tapering frusto-conical portion, in turn preceded by a slightly forwardly tapered terminal portion, the needle being coaxial with the body through bore and defining therewith an annular liquid passage, said needle being axially adjustable within said body through bore, an inlet for said liquid passage opening at said main cylindrical portion of said through bore.

3. A liquid supply system and nozzle as claimed in claim 2, wherein the needle main cylindrical portion extends forwardly partly opposite the frusto-conical portion of said body through bore.

4. A liquid supply and nozzle system as claimed in claim 3, wherein the frusto-conical portions of said body through bore and of said needle have slightly unequal angles of taper to define an annular passage which slightly decreases in width forwardly of the body through bore.

5. A liquid supply system and nozzle as claimed in claim 4, wherein the terminal portion of said needle slightly tapers forwardly at an angle of approximately 4 degrees to define a slightly diverging annular passage with said outlet bore portion of said body.

6. A liquid supply system and nozzle as claimed in claim 5, further including an enlarged diameter mouth protruding from the outlet cylindrical portion of said body through bore.

7. In a jet weaving loom as claimed in claim 2, wherein said valve is an electro-magnetic valve and said pulse generating means generate an electric pulse.

8. A liquid supply system and nozzle as claimed in claim 2, wherein said means to supply liquid to the inlet of said valve includes a liquid supply line and series-connected liquid filter and liquid pressure regulating valve.

9. A liquid supply system and nozzle as claimed in claim 8, further including an air bleeding valve and a liquid accumulator preventing liquid hammer in the line.

10. A nozzle as claimed in claim 2 wherein said outlet cylindrical portion of restricted diameter has a length of approximately 1 inch.

11. In a jet weaving loom, a nozzle as claimed in claim 6, said nozzle including a body having a through bore and a needle inserted in said through bore and having said axial yarn passage, said body through bore and needle defining therebetween said annular liquid passage and front outlet, and means to adjust the axial position of said needle in said body to change the width of said annular passage.

12. In a jet weaving loom, the improvement comprising a nozzle for propelling a weft yarn across the open shed of warp yarns, said nozzle comprising a body having a through bore, a needle inserted in said through bore and having an axial yarn passage, said body through bore defining a main cylindrical portion preceded by a forwardly tapering frusto-conical portion, in turn preceded by an outlet cylindrical portion of restricted diameter, all said three portions merging with one another, said needle defining a main cylindrical portion preceded by a forwardly tapering frusto-conical portion, in turn preceded by a slightly forwardly tapered terminal portion, the needle being coaxial with the body through bore and defining an annular liquid passage therewith, means to adjustably position said needle axially of said through bore, said body having a liquid inlet in communication with said liquid passage at said main cylindrical portion of said through bore.

13. A nozzle as claimed in claim 12, wherein the needle main cylindrical portion extends forwardly partly opposite the frusto-conical portion of said body through bore.

14. A nozzle as claimed in claim 13, wherein the frusto-conical portions of said body through bore and of said needle have slightly unequal angles of taper to define an annular passage which slightly decreases in width forwardly of the body through bore.

15. A nozzle as claimed in claim 14, wherein the terminal portion of said needle slightly tapers forwardly to an angle of approximately 4° to define a slightly diverging annular passage with said outlet bore portion of said body.

16. A nozzle as claimed in claim 15, further including an enlarged diameter mouth protruding from the outlet cylindrical portion of said body through bore.

17. A nozzle as claimed in claim 15, wherein said forwardly tapering frusto-conical portion forms an angle of between 18° and 22° with an axis of the through bore.

* * * * *

UNITED STATES PATENT OFFICE

CERTIFICATE OF CORRECTION

Patent No. 4,074,727 Dated February 21, 1978

Inventor(s) Clyde Chi Kai KWOK and Joseph René CORNELLIER

It is certified that error appears in the above-identified patent and that said Letters Patent are hereby corrected as shown below:

In the Patent the Priority claimed should appear as follows:

Foreign Application Priority Data

June 9, 1975 Canada ..... 228,830

Signed and Sealed this

Fifth Day of June 1979

[SEAL]

Attest:

RUTH C. MASON
*Attesting Officer*

DONALD W. BANNER
*Commissioner of Patents and Trademarks*